United States Patent [19]

Kelly et al.

[11] 4,053,090

[45] Oct. 11, 1977

[54] CAP AND VALVE ACTUATOR FOR SPRAY DISPENSERS

[75] Inventors: Ronald L. Kelly, Elk Grove; Efrem M. Ostrowsky, Highland Park, both of Ill.

[73] Assignee: VCA Corporation, Baton Rouge, La.

[21] Appl. No.: 499,462

[22] Filed: Aug. 22, 1974

[51] Int. Cl.[2] ..... B65L 83/14

[52] U.S. Cl. ..... 222/402.13; 222/182

[58] Field of Search ..... 222/153, 182, 402.11–402.15

[56] References Cited

U.S. PATENT DOCUMENTS

| | | | |
|---|---|---|---|
| 3,137,885 | 6/1964 | Hulsh | 222/402.13 X |
| 3,253,749 | 5/1966 | Sagarin | 222/182 |
| 3,407,975 | 10/1968 | Schroeder | 222/402.13 |
| 3,554,366 | 1/1971 | Corll | 222/182 X |
| 3,726,444 | 4/1973 | Ostrowsky | 222/402.11 |
| 3,744,682 | 7/1973 | Blank | 222/402.13 X |
| 3,770,168 | 11/1973 | Sagarin | 222/182 |
| 3,958,726 | 5/1976 | Trotta | 222/182 X |

*Primary Examiner*—Robert B. Reeves
*Assistant Examiner*—Frederick R. Handren
*Attorney, Agent, or Firm*—Donald L. Johnson; John F. Sieberth; E. Donald Mays

[57] ABSTRACT

A cap and valve actuator for spray dispensers used with aerosol containers, which includes a cap and a valve actuator member positioned therewithin and with the valve actuator member cooperating with the depressible discharge part of the spray dispenser, with the cap body having a circumference substantially that of the aerosol container so as not to extend substantially outwardly thereof, to permit the containers with caps thereon to be positioned contiguous to each other, and with the cap having an outlet opening at the front side thereof; the cap having a finger receiving socket extending inside the cap and accessible through a side rear opening in the cap body; the valve actuator having a socket for engagement with the valve stem of the aerosol container and a forwardly extending portion extending substantially to the front side outlet opening of the cap, with the forwardly extending portion of the actuator having a duct communicating with the socket engaging the valve stem of the aerosol container. The horizontally extending portion of the actuator has a projection at the forward end which is manually engageable by the forepart of the finger of the hand for manual depression through the forwardly extending portion of the actuator and through the outlet opening of the cap, the finger receiving socket and the projection for operating the valve actuator being such that the finger must be inserted deep into the finger receiving socket for forepart of any finger to actuate the valve actuator, thereby providing a unit which can be operated by adults but normally not by children.

4 Claims, 10 Drawing Figures

CAP AND VALVE ACTUATOR FOR SPRAY DISPENSERS

BRIEF SUMMARY OF THE INVENTION

This invention is an improvement on the Sagarin U.S. Pat. No. 3,240,397 owned by the common assignee.

One of the objects of this invention is to provide a safety cap and a valve actuator within the cap so constructed that the cap has a finger receiving socket accessible from the rear of the cap body and the finger receiving socket has a length so that a substantial portion of the finger is insertable into the socket, with the valve actuator being positioned so that the forepart of the forefiner or any other finger of the hand must extend into the forepart of the cap before it can engage the valve actuator to depress same and thereby actuate the valve stem of the aerosol container.

Another object of this invention is to provide a cap having the foregoing objectives in which the body of the cap has substantially the circumference of the container, with the cap having no overhanging portion to permit containers with the caps thereon to be positioned contiguous to each other.

Another object of this invention is to provide means of the foregoing character having the foregoing objectives in which the top wall of the cap is substantially flat so that one container may be stacked on top of another.

Another object of this invention is to make it difficult if not impossible for a young child to operate the device since the finger of a child would not normally extend into the portion of the finger receiving socket to permit the forepart of the forefinger or any other finger to engage the valve actuating member.

Figure 2:
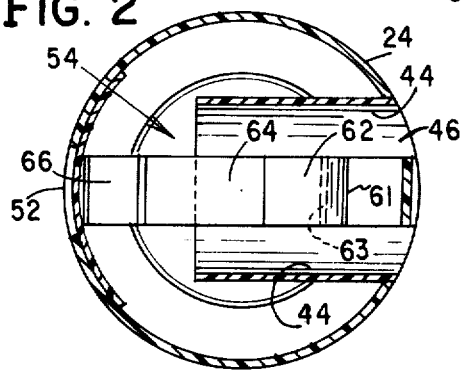
FIG. 2 is a view taken on line 2—2 of FIG. 1.

In the embodiments shown, the cap and the valve actuator means are each separately formed with the valve actuator means positioned and secured inside the cap and mounted on a conventional aerosol container for the purpose of protecting the aerosol valve against any accidental operation and also to prevent the valve actuator from being actuated by a child.

FIGS. 1 - 5

The construction shown in FIGS. 1 through 5 will be first described. The conventional aerosol container is indicated generally at 10 and comprises a cylindrical body 11 provided with the conventional closure top 12 which is generally dome-shaped and is suitably secured as at 13 to the container body to define an annular chime or well 14 between the container body and the closure top 12. Secured to the dome-shaped closure top 12 of the can is a conventional mounting cup 16 provided with the conventional groove or annular recess 18. The conventional aerosol valve stem indicated at 20 is biased to closed position by a spring, not shown, contained therewithin to normally bias the valve stem in its "up" position to maintain said valve stem closed. The valve stem is provided with the usual outlet or discharge opening 22 at the top thereof, it being understood that when the valve stem 20 is depressed the material in the container will be discharged through said valve stem opening into and through the valve actuator, as will be more specifically described.

The cap, generally indicated at 24, is integrally molded or formed of plastic and has a generally cylindrical body 26, with the upper portion of said body having a slight inward incline. The lower end or skirt 28 of the cylindrical body has a greater circumference than the upper portion of the cap and is connected by an inclined shoulder 30. The cylindrical body of the cap adjacent the shoulder 30 is provided with a plurality of spaced slots or openings 32 which are adapted to receive the spaced outwardly extending ears of the valve actuator, as will be presently described, to couple the actuator to the cap.

Figure 5:
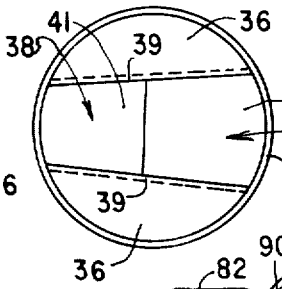
FIG. 5 is a reduced top plan view taken on line 5—5 of FIG. 1.

The cap 24 is formed with a closed top wall, generally indicated at 34, which for the major part is substantially horizontally flat except for a central rear portion which is inclined rearwardly and downwardly to form the top wall of the finger receiving socket. The top wall 34 of the cap has spaced end portions 36 and a central portion 38. The sides 39 of the central portion 38 are inclined or angled inwardly from the rear toward the front and the width of the central portion is greater adjacent the rear of the cap, as best seen in FIG. 5. From approximately the center of the central portion 38, the central portion inclines downwardly toward the opening in the rear side wall of the cap, said inclined central portion being designated by the numeral 40, which also forms the top wall of the finger receiving socket, to be described. The top wall of the central portion extending forwardly thereof is designated at 41.

The portions of the top wall 34 of the cap designated at 36 and 41 are generally flat and are on substantially the same horizontal plane, while the rear central portion 40 inclines rearwardly and downwardly thereof. The sides 39 of the rear central portion 40 extend upwardly to form vertically extending side walls 42 which connect with the top wall sections 36. The rear edge 43 of the rear central portion 40 terminates flush with the rear side wall of the cylindrical-shaped cap body.

Formed integrally with said cap is a U-shaped portion 44, the opposite sides 45 of which extend upwardly therefrom to connect with the inclined top wall portion 40. The U-shaped portion 44 and its sides 45, with the inclined central portion 40, form a finger receiving socket generally indicated at 46 which communicates with an opening 48 in the rear side wall of the cap. The bottom of the U-shaped portion has a radius as at 49 at the entrance to the finger receiving socket 46. The bottom wall of the U-shaped portion is indicated at 44'. The front edge 50 of the bottom wall of the finger receiving socket terminates at the point rearwardly of the finger engaging portion of the valve actuator member and slightly above the horizontal plane of the finger engaging projection to be described. The top and bottom walls 40 and 44' of the finger receiving socket 46 have the same angular inclination and the axis of both are parallel. The front side wall of the cap is provided with an enlarged opening 52 through which the aerosol material is discharged, as will be subsequently described.

The valve actuator, generally indicated at 54, comprises an annular cylindrical body 55 with downwardly and outwardly inclined portions 56, with an annular short vertical skirt 57 with spaced radially extending ears 58 which engage the openings or slots 32 in the cap 24 to secure the valve actuator to the cap.

Figure 1:
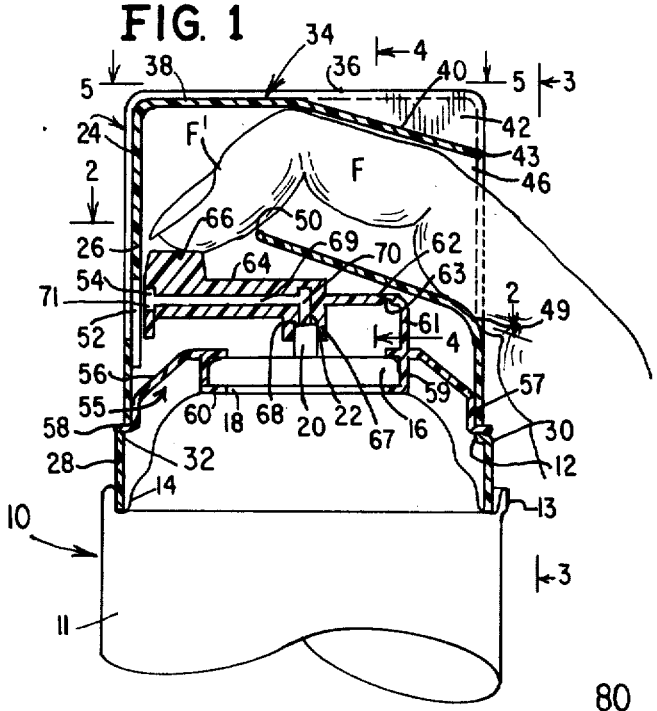
FIG. 1 is a central sectional view of the cap and valve actuator means of this invention secured to a conventional aerosol container and showing the position of the finger necessary to actuate the valve actuator means.
Figure 4:
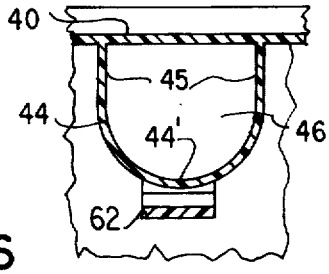
FIG. 4 is a sectional view taken on line 4—4 of FIG. 1 with the finger removed.
Figure 3:
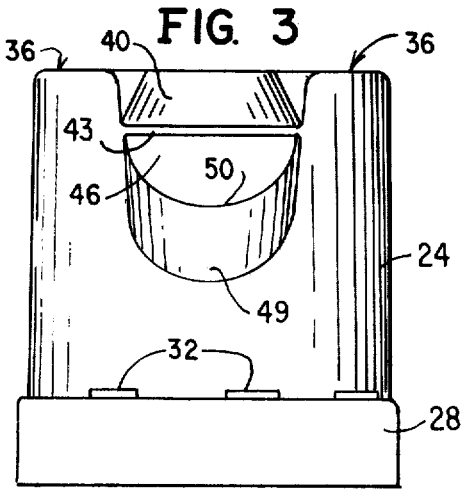
FIG. 3 is a view taken on line 3—3 of FIG. 1.

Spaced inwardly of the cylindrical body 55 is a ring-like member 59 having an inwardly extending annular lip 60 at the bottom to engage the annular groove 18 on the mounting cup 16 to secure the valve actuator to the container. Extending upwardly of the rear of the ring-like member 59 is a vertical strip 61 which continues with a forwardly horizontally extending strip 62 having a transverse groove or recess 63 to provide a hinge line at said point. Extending forwardly of the strip 62 is a strip 64 having an upwardly extending finger engaging projection 66 at the front end thereof. The strip 62 has a short depending hollow stem 67 forwardly of the strip 62 and said depending stem has an internal annular shoulder 68 with the hollow stem 67 adapted to engage the aerosol valve stem 20 and the shoulder 68 engaging the top of said valve stem. The strip 62 has an internal passageway 69 communicating with a vertical passageway 70 in the hollow stem 67. The front end of passageway 69 is enlarged as at 71 and communicates with the cap opening 52. When the finger F is positioned as shown in FIG. 1 and the projection 66 of the valve actuator 54 is depressed by the forepart of the forefinger or any other finger, the strips 62 and 64 will hinge at 63 and depress the valve 20 of the aerosol container to release the aerosol material which passes through passageways 70 and 69 and out through opening 52 in the cap. The entire valve actuator member 54 is integrally formed and molded of a plastic material.

The valve actuator 54 is positioned inside the cap 24 through the bottom opening of the cap, with the ears 58 of the valve actuator snapped into the slots 32 of the cap so that the actuator is retained in said cap. When the cap and actuator as a unit is applied to the top of the aerosol container the inwardly extending flange 60 of the ring 59 of the actuator will become locked and in engagement with the annular groove 18 in the mounting cup 16 to thereby secure the valve actuator to the mounting cup of the container, with the bottom of the skirt 28 of the cap resting in the well or chime 14 of the container. The valve actuator 54 is thus secured to the cap and the cap and actuator are secured as a unit to the aerosol container.

It will be seen that the circumference of the cap 24 is substantially that of the circumference of the container and no portion of the cap extends outwardly beyond the side wall of the container so that containers with their caps and valve actuators may be positioned contiguous to each other at any circumferential position of the cap or container. In addition, the top wall of the cap is substantially flat or on a horizontal plane so that the containers can be stacked one on top of the other for storage and/or shipment and the shape of the cap does not interfere with the positioning of one container on top of another, with the caps secured to the containers.

OPERATION

To operate the device, the finger F of the hand is inserted into the finger receiving socket 46 and the forepart F' of the forefinger, or any other finger, is bent downwardly and pressed down against the upward projection 66 of the valve actuator to cause the horizontal portion of the actuator to be depressed or hinged at the hinge line 63. This depressing of the actuator will depress the aerosol valve 20 and will open the valve to cause the aerosol material to be dispensed through the aerosol valve, through the vertical conduit 70 and through the horizonal conduit 69 and then through the outlet opening 52 in the cap to be discharged therefrom. When manual pressure on the projection 66 is released the valve actuator 54 will assume its normal horizontal position as shown in FIG. 1 and the spring inside the aerosol valve 20 will close the aerosol valve.

By virtue of this construction the forepart of the forefinger or any other finger must be bent downwardly to engage the upwardly extending projection 66 to depress the valve actuator. Inserting a rigid instrument through the finger receiving socket for the purpose of actuating the actuator will not depress the actuator and the finger of a child would not be long enough to pass through the finger receiving socket to reach the actuator, thus, a child is prevented from operating the valve actuating device. It also serves as a means for protecting the valve actuating device from any object which may be placed on the cap.

Figure 7:
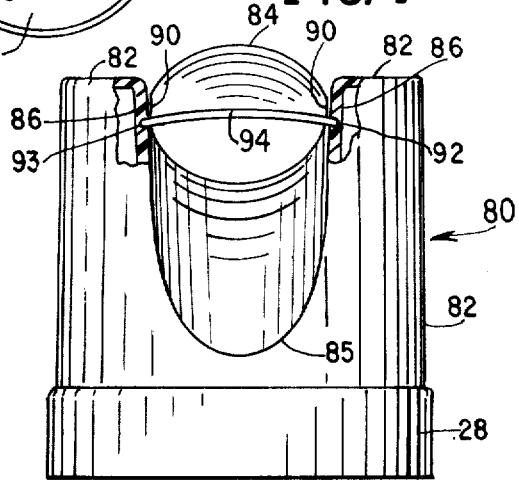
FIG. 7 is a view taken on line 7—7 of FIG. 6 with the finger removed.
Figure 6:
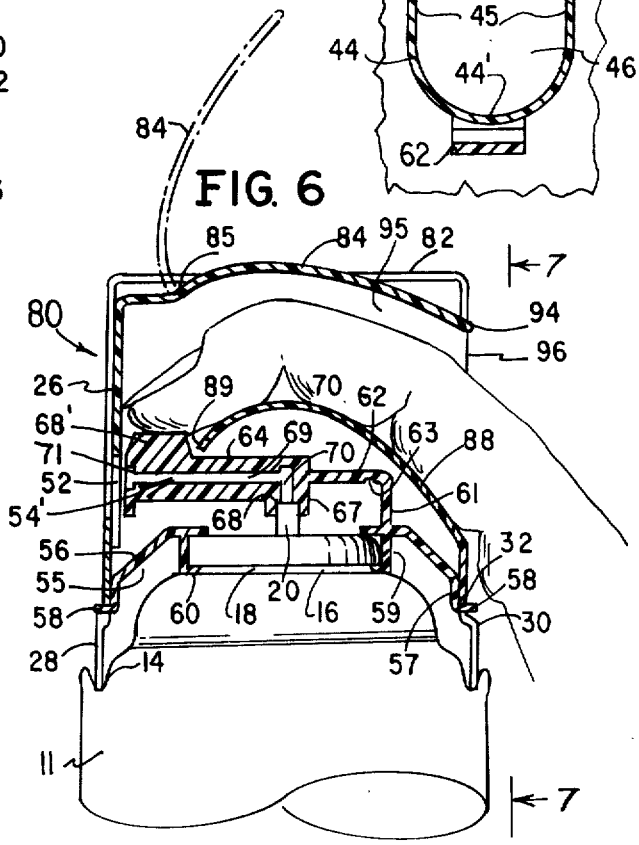
FIG. 6 is a central sectional view of a modified cap and showing in dotted lines the position of the flap which forms a portion of the top of the cap in the position it assumes when it is formed in the plastic molding machine, and in sectional lines the position of said flap when it is secured to the cap to form the top wall of the finger receiving socket.

FIGS. 6 and 7

FIGS. 6 and 7 show a modified cap generally indicated at 80. The aerosol actuator which is used with this cap is identical to the valve actuator 54 used in connection with the cap previously described. It is shown in side elevation in FIG. 6 and is generally identified by the numeral 54' and the parts thereof will not be redescribed.

The valve actuator 54' is interlocked with the cap 80 in the same manner as previously described. The modification in cap 80 resides principally in the central top wall of the cap and the shape of the finger receiving socket and only those differences will be specifically described, the remainder of the cap being substantialy like cap 24 previously described.

The top wall of cap 80 is molded to form spaced top flat horizontal portions 82 with a bowed central flap 84 therebetween. When the cap is molded in an injection molding machine the central flap 84 is positioned in the upright position shown in dotted lines in FIG. 6 and is bendable or hingeable as at 85. The spaced top horizontal portions 82 each have a downwardly extending wall 86 which merges into a bottom wall 88, with the bottom wall curved or bowed longitudinally, as shown in section in FIG. 6, and with the front edge 89 thereof terminating downwardly of the projection 68' of the valve actuator 54' and spaced therefrom. The central flap 84 is curved or bowed in transverse section, as best seen in FIG. 7, with the spaced sides 90 thereof extending parallel to the sides 86. The central flap 84 is also curved or bowed longitudinally as shown in FIG. 6. The spaced sides 86 have spaced recesses 92 which are engaged by the projections 93 on the sides of central flap 84. The rear end 94 of the flap 84 will when in locked position, as shown in FIG. 7, terminate substantially flush with the rear side wall of the cylindrical cap and will when in such locked position also have a longitudinal bowed shape. The flap 84, spaced sides 86 and bottom wall 88 form a finger receiving socket 95 which receives the finger F through the opening 96 in the rear side wall of the cylindrical body. In top plan the central flap 84 has the shape outlined by the central portion of the cap 24.

After the cap is formed and ejected from the plastic molding machine with the flap 84 in its raised position, as seen in FIG. 6, the flap is lowered to the position shown in cross-section in said Figure and is retained and locked between the inner side walls 86 of the cap. When the flap 84 is lowered from the dotted line position of FIG. 6 to the sectional position in said Figure and interlocked with the inner sides it completes the top wall of the cap and the top wall is on a substantially flat horizontal plane, except for the upper curved portion of the flap 84 which extends slightly above the top plane of the opposite side sections 82, however, this will not interfere with the positioning of one container on top of another and with the container resting on the top wall, since while a portion of the flap extends above the horizontal plane of the sides and top wall, most container cans have a convex bottom so that there would be no interference and the top wall can be considered substantially a horizontal flat surface and containers can be stacked one on top of the other.

The finger receiving socket 95 has a curved or bowed surface so that when the finger is inserted it has to be arched to a greater degree than in connection with the finger receiving socket shown in the first embodiment. Thus, in order to operate the value actuator 54' the finger F when inserted, as shown, in addition to being arched must have the forepart of the forefinger or any other finger F' bent downwardly to engage the projection 68' of the valve actuator and when the forepart of the finger is pressed downwardly it will hinge and depress the actuator member to actuate the aerosol valve. This is likewise true in the first embodiment in which the forepart of the finger must be tilted downwardly to engage the top projection of the valve actuator for actuating same.

Figure 8:
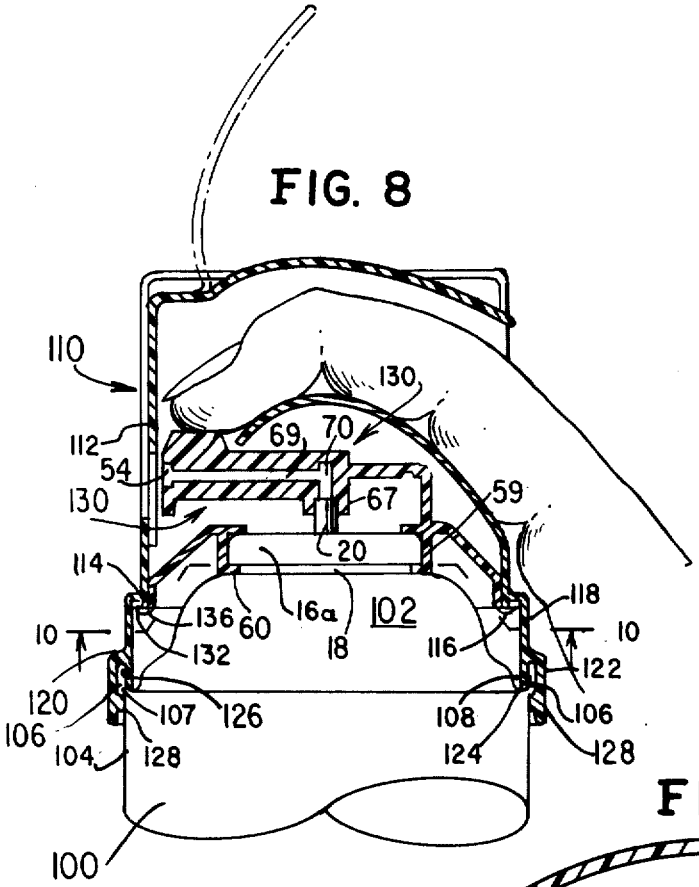
FIG. 8 is a central sectional view of a modified cap and showing the valve actuator attached thereto and also showing the manner of attaching the cap to the conventional aerosol container.
Figure 9:
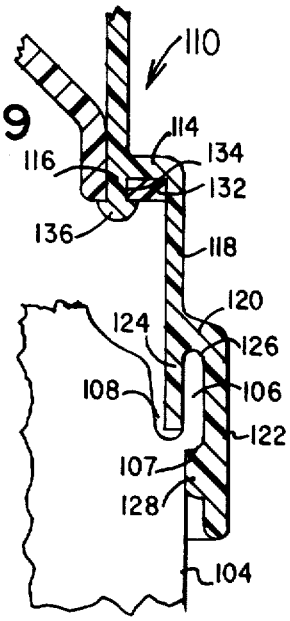
FIG. 9 is an enlarged sectional view taken on the lower right portion of FIG. 8.
Figure 10:
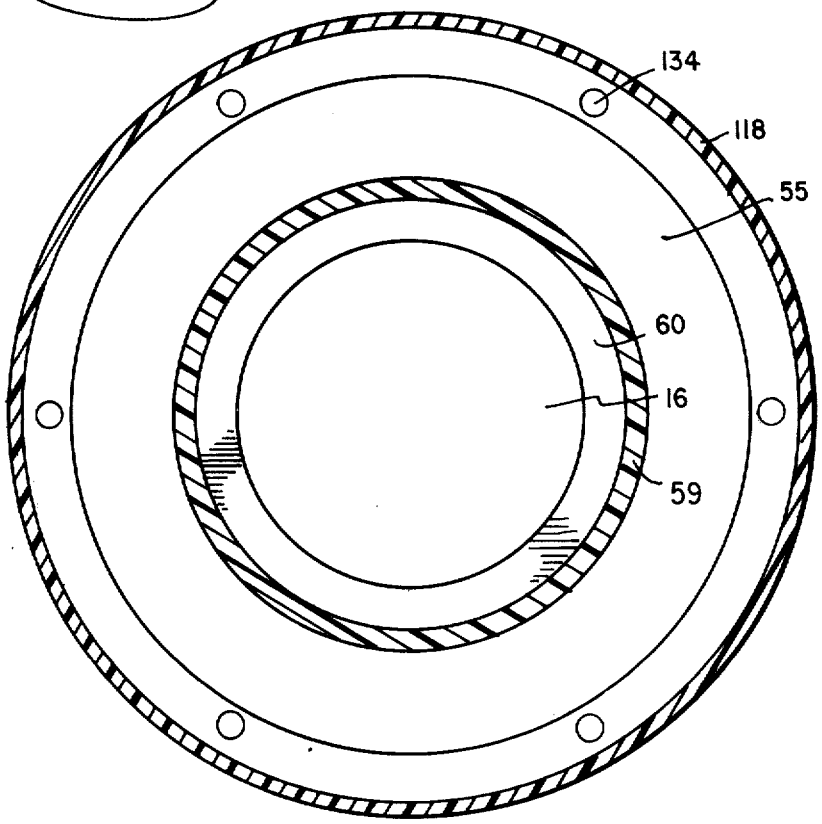
FIG. 10 is a view taken on line 10—10 of FIG. 8.

FIGS. 8, 9 and 10

FIGS. 8, 9 and 10 show a modification of attaching the valve actuator to the cap and the cap to the aerosol container.

The conventional aerosol container is generally indicated at 100 and the conventional closure top 102 is permanently secured to the top of the cylindrical body 104 by the conventional overturned bead or seam 106 which forms an annular shoulder 107 at the bottom thereof which extends outwardly of the cylindrical body 104. The closure top 102 is provided with an annular chime or well 108.

The cap generally indicated at 110 is integrally molded or formed of plastic and has a generally cylindrical body 112 with a slight inward incline. The lower end of the cylindrical body 112 has an annular outwardly extending shoulder 114 provided with spaced downwardly extending plastic pins or studs 116 integrally formed with the cap. Extending downwardly from the shoulder 114 is an annular enlarged skirt portion 118 which continues with a second annular outwardly extending shoulder 120 and terminates in an enlarged outer cylindrical bottom portion 122. The enlarged annular portion 118 continues downwardly to form an inside annular extension 124 which with the bottom portion 122 forms an annular recess, pocket or groove 126 open at the bottom. The inside surface of the bottom portion 122 is provided with an inwardly extending annular projection 128.

The balance of the cap 110 may be made similar to that of FIG. 1 or FIG. 6 and provided with either of the shaped finger receiving sockets for receiving the finger, as previously described. For illustrative purpose, only the finger receiving socket shown in FIG. 6 is shown in FIG. 8 although it will be understood that the cap 110 may have its top wall and finger receiving socket formed as shown in FIG. 1.

The valve actuator generally indicated at 130 is identical to the valve actuators previously described, except that valve actuator 130 does not have radially extending ears like ears 58 of FIG. 1 but is provided with an annular outwardly extending flange 132 provided with spaced openings 134 to receive the pins or studs 116 formed on the cap. When the pins or studs 116 are inserted in the spaced openings 134, the pins or studs 116 are headed by heating means to form heads 136 which permanently secure the valve actuator 130 to the cap 110.

The cap 110 with the valve actuator 130 thus attached thereto is positioned on the top of the container and the grooved or recessed portion 126 of the cap is secured to the top seam or bead 106 of the container by the projection 128 engaging the bottom shoulder 107 to secure the cap to the container. The inside extension 124 of the cap extends into the annular chime or well 108. The valve actuator is also secured to the mounting cup 16*a* similarly to that previously described in connection with FIGS. 1 and 6. The valve actuator 130 in this embodiment is thus fixedly secured to cap 110 and forms in effect an integral unit therewith, with the valve actuator being secured to the mounting cup of the aerosol container and with the cap also secured to the container through the bead or seam 106 in engagement with the projection 128 of the cap.

With respect to all of the embodiments it will be noted that the finger must extend into the finger receiving socket substantially to the front side wall of the cylindrical cap. In other words, the finger must extend into the front end of the finger receiving socket before the valve actuator can be manually actuated.

With this invention it would be impossible for a child to operate the device. It could be operated only by an adult and thus provides for a safety device. Also, no portion of the cap extends beyond the circumference of the container and therefore containers can be positioned adjacent each other without interference from the caps and in addition the containers can be stacked one above the other by virtue of the substantially flat top wall of the cap.

What is claimed is:

1. A two-piece cap and valve actuator for use in connection with an aerosol spray dispenser which is part of an aerosol container, comprising: a cap and a separate valve actuator member positioned therewithin, one of said cap and said valve actuator member having spaced openings around its lower portion to receive spaced ears provided on the other of said cap and said valve actuator member to secure said cap to said actuator, said cap positioned over the top of the aerosol container and with the valve actuator member cooperating with the depressible discharge part of the spray dispenser, said cap having a cap body with a circumference substantially that of the aerosol container so as not to extend substantially outwardly thereof to permit containers with caps to be positioned contiguous to each other, said cap having an outlet opening at the front side thereof, said cap having a finger receiving socket extending inside said cap and accessible through a side rear opening of the cap body, said actuator having means for engagement with the valve stem of the aerosol container and a forwardly extending portion extending substantially to the front side outlet opening of the cap, said forwardly extending portion of the actuator having a duct communicating with the means engaging the valve stem of the aerosol container, said forwardly extending portion of the actuator having means at the forward end which is manually engageable by the forepart of the finger of the hand for manual depression to thereby operate said aerosol valve stem and permit the discharge through the forwardly extending portion of said actuator and through the outlet opening of said cap, said finger receiving socket having a rigid, fixed bottom wall which extends at least over and past said valve stem and terminates short of said means engageable by the forepart of the finger at the forward end of said forwardly extendng portion of said actuator.

2. A cap and valve actuator as set forth in claim 1 in which the cap and valve actuator are formed of plastic and the valve actuator is permanently attached to the cap by means of said spaced ears in the form of pins or studs received in said spaced openings in an annular outwardly extending flange provided on the valve actuator member, said pins or studs having heads on the ends thereof to permanently attach said valve actuator to said cap.

3. A cap and valve actuator as set forth in claim 1 in which the bottom wall of the finger receiving socket is rearwardly inclined but substantially on a straight plane.

4. A cap and valve actuator as set forth in claim 1 in which the finger receiving socket includes a top wall, opposed sidewalls, and a bottom wall interconnected to form a generally U-shaped opening in transverse section.

* * * * *